US008109725B2

(12) United States Patent
Abdel-Messeh et al.

(10) Patent No.: US 8,109,725 B2
(45) Date of Patent: Feb. 7, 2012

(54) AIRFOIL WITH WRAPPED LEADING EDGE COOLING PASSAGE

(75) Inventors: William Abdel-Messeh, Middletown, CT (US); Justin D. Piggush, Hartford, CT (US)

(73) Assignee: United Technologies Corporation, Hartford, CT (US)

( * ) Notice: Subject to any disclaimer, the term of this patent is extended or adjusted under 35 U.S.C. 154(b) by 622 days.

(21) Appl. No.: 12/334,665

(22) Filed: Dec. 15, 2008

(65) Prior Publication Data

US 2010/0150733 A1 Jun. 17, 2010

(51) Int. Cl.
*F01D 5/08* (2006.01)

(52) U.S. Cl. ..... 416/96 R; 416/97 R

(58) Field of Classification Search ..... 416/96 R, 416/97 R

See application file for complete search history.

(56) References Cited

U.S. PATENT DOCUMENTS

| | | | | |
|---|---|---|---|---|
| 3,978,731 | A | 9/1976 | Reeder et al. | |
| 5,486,093 | A * | 1/1996 | Auxier et al. | 416/97 R |
| 5,735,335 | A | 4/1998 | Gilmore et al. | |
| 5,820,337 | A | 10/1998 | Jackson et al. | |
| 6,000,906 | A | 12/1999 | Draskovich | |
| 6,139,258 | A | 10/2000 | Lang, III et al. | |
| 6,164,912 | A | 12/2000 | Tabbita et al. | |
| 6,234,755 | B1 | 5/2001 | Bunker et al. | |
| 6,247,896 | B1 | 6/2001 | Auxier et al. | |
| 6,280,140 | B1 | 8/2001 | Soechting et al. | |
| 6,607,355 | B2 | 8/2003 | Cunha et al. | |
| 6,705,831 | B2 | 3/2004 | Draper | |
| 6,890,154 | B2 | 5/2005 | Cunha | |
| 6,896,487 | B2 | 5/2005 | Cunha et al. | |
| 6,913,064 | B2 | 7/2005 | Beals et al. | |
| 6,929,054 | B2 | 8/2005 | Beals et al. | |
| 6,932,145 | B2 | 8/2005 | Frasier et al. | |
| 6,932,571 | B2 | 8/2005 | Cunha et al. | |
| 6,955,522 | B2 | 10/2005 | Cunha et al. | |

(Continued)

FOREIGN PATENT DOCUMENTS

| | | |
|---|---|---|
| EP | 0 924 382 | 12/1998 |

OTHER PUBLICATIONS

Extended European Search Report for Application No. EP 10 00 5822 dated Dec. 6, 2010.

*Primary Examiner* — Kiesha Bryant
*Assistant Examiner* — Mark Tornow
(74) *Attorney, Agent, or Firm* — Carlson, Gaskey & Olds, P.C.

(57) ABSTRACT

A turbine engine airfoil includes an airfoil structure having an exterior surface providing a leading edge. A radially extending first cooling passage is arranged near the leading edge and includes first and second portions. The first portion extends to the exterior surface and forms a radially extending trench in the leading edge. The second portion is in fluid communication with a second cooling passage. In one example, the second cooling passage extends radially, and the first cooling passage wraps around a portion of the second cooling passage from a pressure side to a suction side between the second cooling passage and the exterior surface. In the example, the first portion is arranged between the pressure and suction sides. In one example, the first cooling passage is formed by arranging a core in an airfoil mold. The trench is formed by the core in one example.

16 Claims, 3 Drawing Sheets

U.S. PATENT DOCUMENTS 6,994,521 B2 2/2006 Liang
7,014,424 B2 3/2006 Cunha et al.
7,097,424 B2 8/2006 Cunha et al.
7,097,425 B2 8/2006 Cunha et al.
7,108,045 B2 9/2006 Wiedemer et al.
7,131,818 B2 11/2006 Cunha et al.
7,137,776 B2 11/2006 Draper et al.
7,172,012 B1 2/2007 Memmen
7,174,945 B2 2/2007 Beals et al.
7,185,695 B1 3/2007 Santeler
7,216,689 B2 5/2007 Verner et al.
7,217,094 B2 5/2007 Cunha et al.
7,217,095 B2 5/2007 Pietraszkiewicz et al.
7,220,103 B2 5/2007 Cunha et al.
7,255,536 B2 8/2007 Cunha et al.
7,258,156 B2 8/2007 Santeler
7,270,170 B2 9/2007 Beals et al.
7,302,990 B2 12/2007 Bunker et al.
7,303,375 B2 12/2007 Cunha et al.
7,306,024 B2 12/2007 Beals et al.
7,306,026 B2 * 12/2007 Memmen ..... 164/516
7,311,497 B2 12/2007 Sharma et al.
7,311,498 B2 12/2007 Cunha et al.
7,322,795 B2 1/2008 Luczak et al.
7,343,960 B1 3/2008 Frasier et al.
7,364,405 B2 4/2008 Cunha et al.
2005/0156361 A1 7/2005 Holowczak et al.
2006/0107668 A1 5/2006 Cunha et al.
2006/0239819 A1 10/2006 Albert et al.
2007/0048122 A1 3/2007 Van Suetendael, IV et al.
2007/0048128 A1 3/2007 Cunha et al.
2007/0048134 A1 3/2007 Cunha et al.
2007/0104576 A1 5/2007 Cunha et al.
2007/0147997 A1 6/2007 Cunha et al.
2007/0172355 A1 7/2007 Cunha et al.
2007/0177975 A1 * 8/2007 Luczak et al. ..... 416/97 R
2007/0177976 A1 8/2007 Cunha et al.
2007/0224048 A1 9/2007 Abdel-Messeh et al.
2007/0227706 A1 10/2007 Lutjen et al.
2007/0248462 A1 10/2007 Lutjen et al.
2007/0286735 A1 12/2007 Cunha et al.
2008/0008599 A1 1/2008 Cunha et al.
2008/0019839 A1 1/2008 Cunha et al.
2008/0019840 A1 1/2008 Cunha
2008/0019841 A1 1/2008 Cunha
2008/0056909 A1 3/2008 Cunha et al.
2010/0054953 A1 3/2010 Piggush

* cited by examiner

AIRFOIL WITH WRAPPED LEADING EDGE COOLING PASSAGE

BACKGROUND

This disclosure relates to a cooling passage for an airfoil.

Turbine blades are utilized in gas turbine engines. As known, a turbine blade typically includes a platform having a root on one side and an airfoil extending from the platform opposite the root. The root is secured to a turbine rotor. Cooling circuits are formed within the airfoil to circulate cooling fluid, such as air. Typically, multiple relatively large cooling channels extend radially from the root toward a tip of the airfoil. Air flows through the channels and cools the airfoil, which is relatively hot during operation of the gas turbine engine.

Some advanced cooling designs use one or more radial cooling passages that extend from the root toward the tip near a leading edge of the airfoil. Typically, the cooling passages are arranged between the cooling channels and an exterior surface of the airfoil. The cooling passages provide extremely high convective cooling.

Cooling the leading edge of the airfoil can be difficult due to the high external heat loads and effective mixing at the leading edge due to fluid stagnation. Prior art leading edge cooling arrangements typically include two cooling approaches. First, internal impingement cooling is used, which produces high internal heat transfer rates. Second, showerhead film cooling is used to create a film on the external surface of the airfoil. Relatively large amounts of cooling flow are required, which tends to exit the airfoil at relatively cool temperatures. The heat that the cooling flow absorbs is relatively small since the cooling flow travels along short paths within the airfoil, resulting in cooling inefficiencies.

One arrangement that has been suggested to convectively cool the leading edge is a cooling passage wrapped at the leading edge. This wrapped leading edge cooling passage is formed by a refractory metal core that is secured to another core. The cores are placed in a mold, and a superalloy is cast into the mold about the cores to form the airfoil. The cores are removed from the cast airfoil to provide the cooling passages. However, in some applications, the wrapped leading edge cooling passage does not provide the amount of desired cooling to the leading edge.

What is needed is a leading edge cooling arrangement that provides desired cooling of the airfoil.

SUMMARY

A turbine engine airfoil includes an airfoil structure having an exterior surface providing a leading edge. A radially extending first cooling passage is arranged near the leading edge and includes first and second portions. The first portion extends to the exterior surface and forms a radially extending trench in the leading edge. The second portion is in fluid communication with a second cooling passage. In one example, the second cooling passage extends radially, and the first cooling passage wraps around a portion of the second cooling passage from a pressure side to a suction side between the second cooling passage and the exterior surface. In the example, the first portion is arranged between the pressure and suction sides. In one example, the first cooling passage is formed by arranging a core in an airfoil mold. The trench is formed by the core in one example.

These and other features of the disclosure can be best understood from the following specification and drawings, the following of which is a brief description.

DETAILED DESCRIPTION

Figure 1:
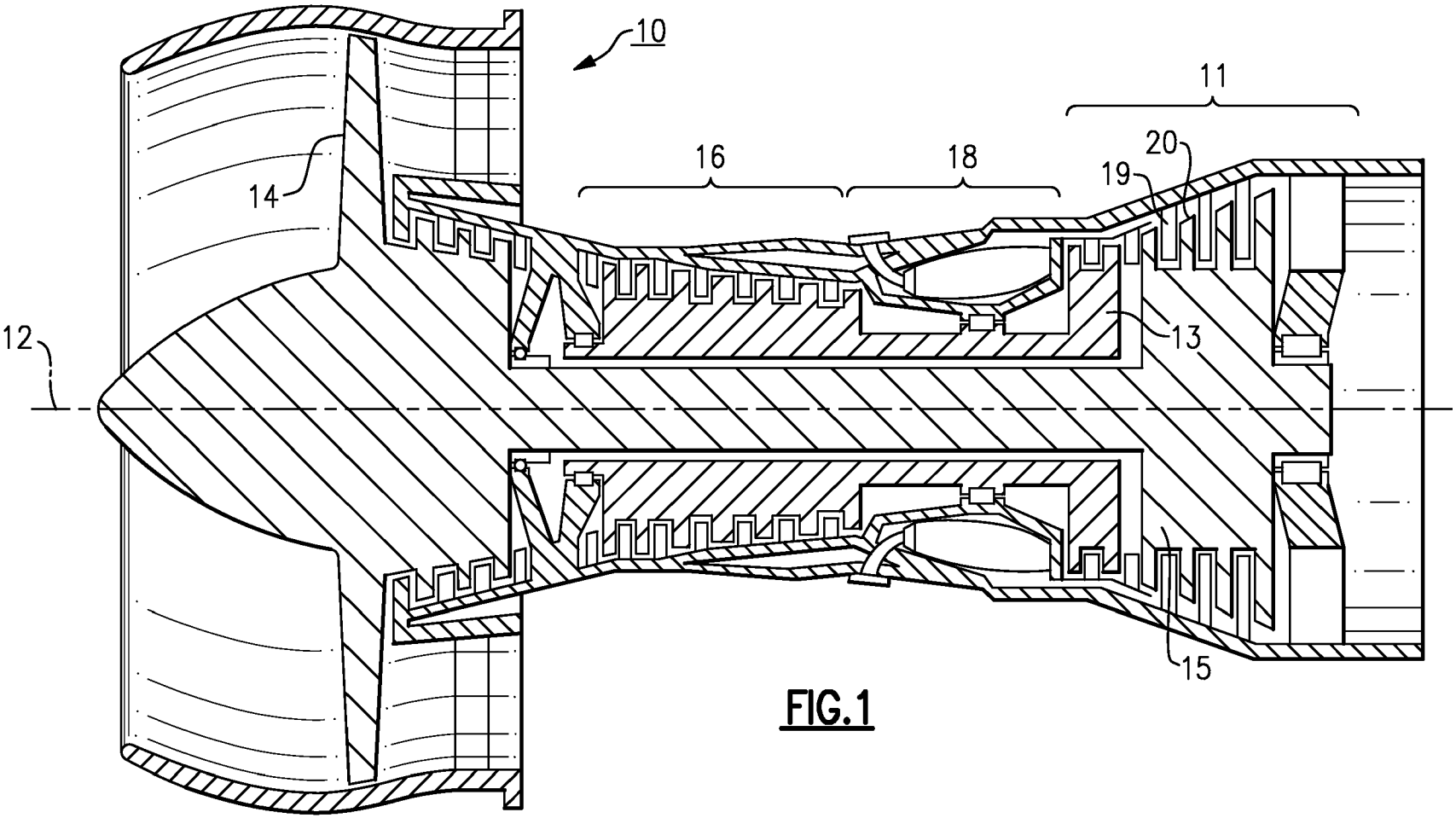
FIG. 1 is a schematic view of a gas turbine engine incorporating the disclosed airfoil.

FIG. 1 schematically illustrates a gas turbine engine 10 that includes a fan 14, a compressor section 16, a combustion section 18 and a turbine section 11, which are disposed about a central axis 12. As known in the art, air compressed in the compressor section 16 is mixed with fuel that is burned in combustion section 18 and expanded in the turbine section 11. The turbine section 11 includes, for example, rotors 13 and 15 that, in response to expansion of the burned fuel, rotate, which drives the compressor section 16 and fan 14.

The turbine section 11 includes alternating rows of blades 20 and static airfoils or vanes 19. It should be understood that FIG. 1 is for illustrative purposes only and is in no way intended as a limitation on this disclosure or its application.

Figure 2:
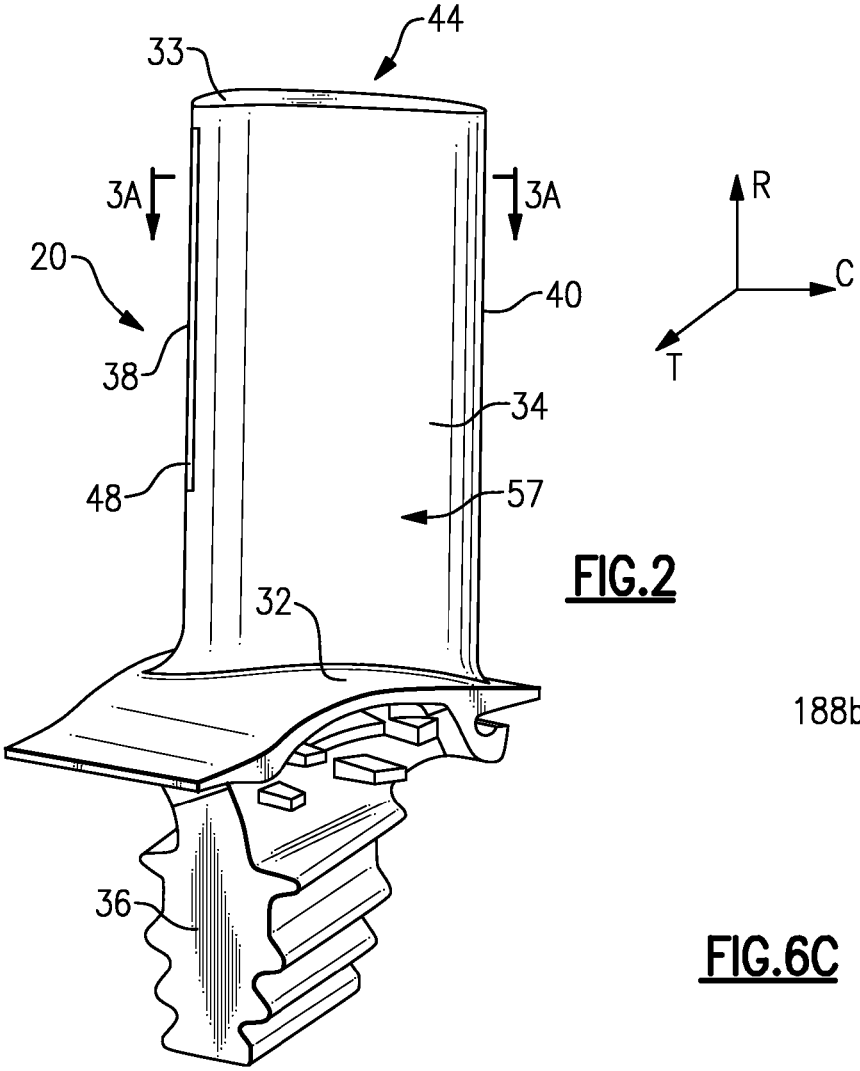
FIG. 2 is a perspective view of the airfoil having the disclosed cooling passage.

An example blade 20 is shown in FIG. 2. The blade 20 includes a platform 32 supported by a root 36, which is secured to a rotor. An airfoil 34 extends radially outwardly from the platform 32 opposite the root 36. While the airfoil 34 is disclosed as being part of a turbine blade 20, it should be understood that the disclosed airfoil can also be used as a vane.

The airfoil 34 includes an exterior surface 57 extending in a chord-wise direction C from a leading edge 38 to a trailing edge 40. The airfoil 34 extends between pressure and suction sides 42, 44 in a airfoil thickness direction T, which is generally perpendicular to the chord-wise direction C. The airfoil 34 extends from the platform 32 in a radial direction R to an end portion or tip 33. A cooling trench 48 is provided on the leading edge 38 to create a cooling film on the exterior surface 57. In the examples, the trench 48 is arranged in proximity to a stagnation line on the leading edge 38, which is an area in which there is little or no fluid flow over the leading edge.

Figure 3A:
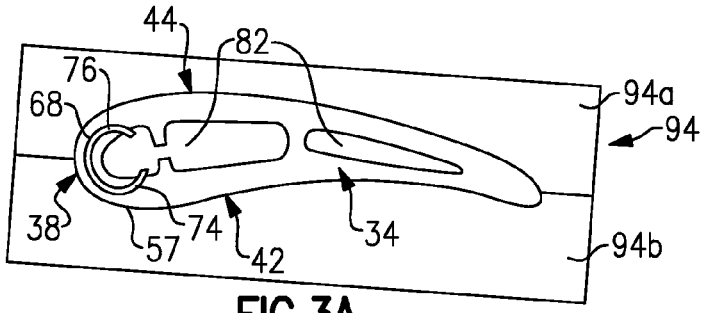
FIG. 3A is a cross-sectional view of a portion of the airfoil shown in FIG. 2 and taken along 3A-3A.
Figure 3B:
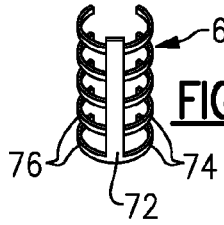
FIG. 3B is a perspective view of a core that provides the wrapped leading edge cooling passage shown in FIG. 3A.
Figure 3C:
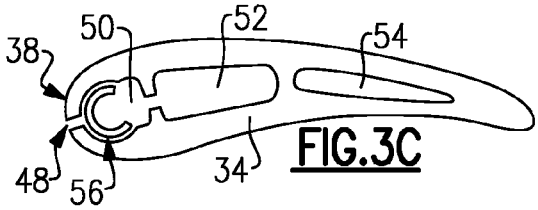
FIG. 3C is a cross-sectional view of the airfoil shown in FIG. 3A with the core removed from the airfoil and a trench formed in the leading edge.

FIG. 3A schematically illustrates an airfoil molding process in which a mold 94 having mold halves 94A, 94B provide a mold contour that defines the exterior surface 57 of the airfoil 34. In one example, cores 82, which may be ceramic, are arranged within the mold 94 to provide the cooling channels 50, 52, 54 (FIG. 3C). Referring to FIG. 3C, multiple, relatively large radial cooling channels 50, 52, 54 are provided internally within the airfoil 34 to deliver airflow for cooling the airfoil. The cooling channels 50, 52, 54 typically provide cooling air from the root 36 of the blade 20.

Current advanced cooling designs incorporate supplemental cooling passages arranged between the exterior surface 57 and one or more of the cooling channels 50, 52, 54. With continuing reference to FIG. 3A, the airfoil 34 includes a first cooling passage 56 arranged near the leading edge 38. The first cooling passage 56 is in fluid communication with the cooling channel 50, in the example shown. One or more core structures 68 (FIGS. 3A and 3B), such as refractory metal cores, are arranged within the mold 94 and connected to the other cores 82. The core structure 68, which is generally C-shaped, provides the first cooling passage 56 in the example disclosed. In one example, the core structure 68 (shown in FIG. 3B) is stamped from a flat sheet of refractory metal material. The core structure 68 is then bent or shaped to a desired contour. The ceramic core and/or refractory metal cores are removed from the airfoil 34 after the casting process by chemical or other means.

A core assembly can be provided in which a portion of the core structure 68 is received in a recess of the other core 82, as shown in FIG. 3A. In this manner, the resultant first cooling passage 56 provided by the core structure 68 is in fluid communication with the cooling channel 50 subsequent to the airfoil casting process.

The core structure 68 includes a first portion 72 and a second portion. In the example shown in FIGS. 3A-3C, the second portion includes multiple, radially spaced first and second sets of arcuate legs 74, 76 that wrap around a portion of the cooling channel 50. The shape of the legs 74, 76 generally mirror the exterior surface 57 of the leading edge 38. The first and second sets of legs 74, 76 are secured to the other core 82. One set of legs 74 is arranged on the pressure side 42 and the other set of legs 76 is arranged on the suction side 44. In the example shown in FIGS. 3A-3C, the first portion 72 does not extend to the exterior surface 57. The trench 48 is formed by a chemical or mechanical machining process, for example, to fluidly connect the first portion 72 to the leading edge 38. Cooling fluid is provided from the first cooling channel 50 through the first cooling passage 56 to provide a cooling film on the leading edge 38 via the trench 48.

Figure 4B:
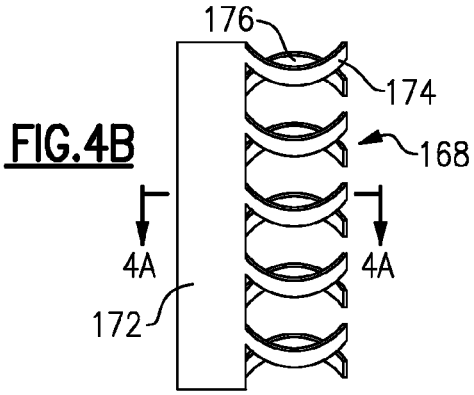
FIG. 4B is a perspective view of the core shown in FIG. 4A.
Figure 4A:
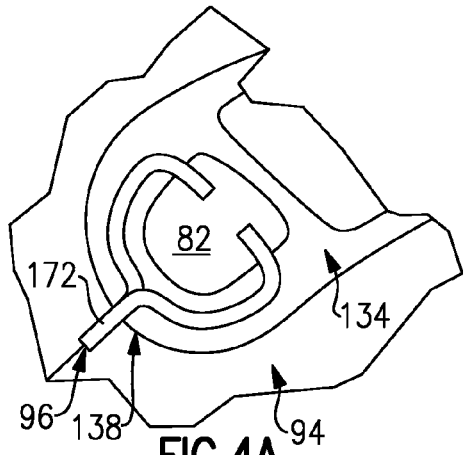
FIG. 4A is a partial cross-sectional view of another airfoil leading edge with another example core.

Referring to FIGS. 4A and 4B, a core structure 168 is shown that provide the trench 48 during the casting process. The first portion 172 extends beyond the exterior surface and into the mold 94 where the first portion 172 is held by a core retention feature 96, which is provided by a notch in the mold 94, for example. Thus, when the core structure 168 is removed from the airfoil 134, a trench will be provided at the leading edge 138. The legs 174, 176 are at an angle or transverse laterally to the first portion 172. The example core structure 168 provides first and second sets of legs 174, 176 on opposite sides and in radially spaced, alternating relationship from one another. The first portion 172 extends in a direction opposite the other core 82.

Figure 5C:
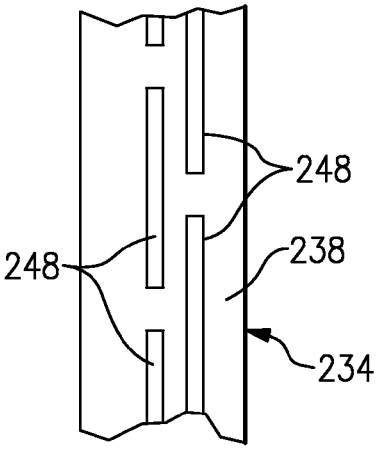
FIG. 5C is a front elevational view of the leading edge shown in FIG. 5A.
Figure 5B:
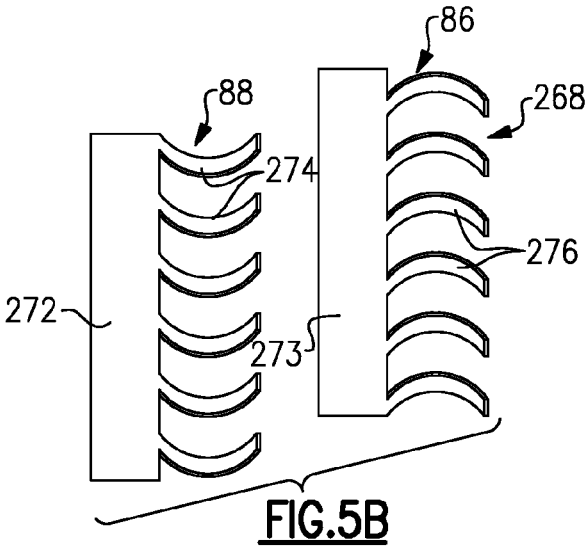
FIG. 5B is a perspective view of the core shown in FIG. 5A.
Figure 5A:
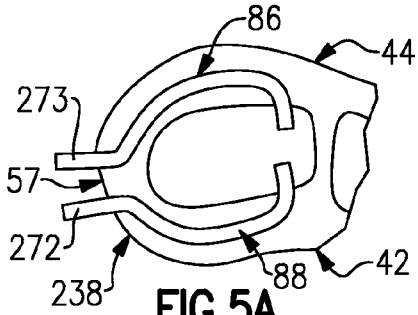
FIG. 5A is a partial cross-sectional view of yet another airfoil leading edge with yet another example core.

The first cooling passage can be provided by multiple separate networks of passageways, as illustrated in FIGS. 5A and 5B. The networks of passageways are formed with multiple core structures 86, 88 having first portions 272, 273 that are discrete from one another. One of the cores structures 86 is arranged on the suction side 44 and the other core structure 88 is arranged on the pressure side 42. The legs 274, 276 are only fluidly connected to one another through the cooling channel 50. The first portions 272, 273 extend beyond the exterior surface 57 in the leading edge 238 and can be configured to provide laterally and/or radially staggered trenches 248 on the airfoil 234, as shown in FIG. 5C.

Figure 6C:
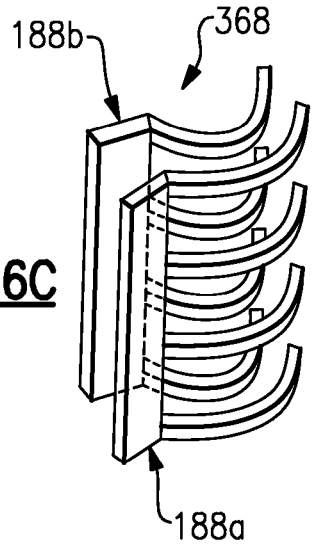
FIG. 6C is a perspective view of a portion of the core shown in FIG. 6A.
Figure 6B:
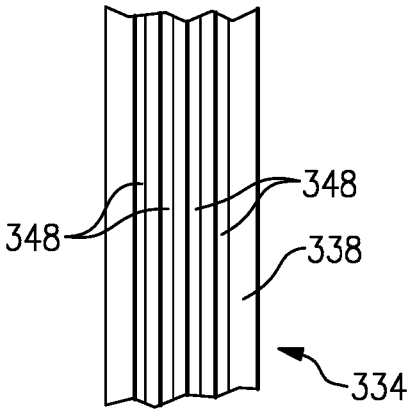
FIG. 6B is a front elevational view of the leading edge shown in FIG. 6A.
Figure 6A:
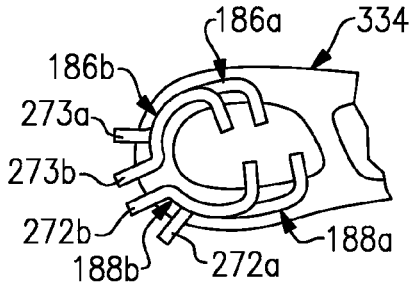
FIG. 6A is a partial cross-sectional view of still another airfoil leading edge with still another example core.

Another arrangement of multiple networks of passageways is shown in FIGS. 6A-6C. The first cooling passage is provided by two networks of passageways created by core structures 186*a*, 186*b*, 188*a*, 188*b* provided on each of the pressure and suction sides 42, 44 of airfoil 334. The core structures 186*a*, 186*b*, 188*a*, 188*b* respectively provide discrete first portions 273*a*, 273*b*, 272*a*, 272*b* that create trenches 348 in leading edge 338, shown in FIG. 6B.

Although example embodiments have been disclosed, a worker of ordinary skill in this art would recognize that certain modifications would come within the scope of the claims. For that reason, the following claims should be studied to determine their true scope and content.

What is claimed is:

1. A turbine engine airfoil comprising:

an airfoil structure including an exterior surface providing a leading edge, a radially extending first cooling passage near the leading edge including first and second portions, the first portion extending to the exterior surface and forming a radially extending trench in the leading edge, the trench providing a radially extending slot in the exterior surface, the second portion in fluid communication with a second cooling passage, wherein the second cooling passage provides multiple discrete passageways radially spaced apart from one another, and the multiple passageways are configured to provide cooling fluid to the trench.

2. The turbine engine airfoil according to claim 1, wherein the second cooling passage extends radially and the first cooling passage wraps around a portion of the second cooling passage from a pressure side to a suction side between the second cooling passage and the exterior surface, the first portion arranged between the pressure and suction sides.

3. The turbine engine airfoil according to claim 2, wherein the first cooling passage is generally C-shaped.

4. The turbine engine airfoil according to claim 2, wherein the first cooling passage is provided by multiple networks of passageways each having a first portion discrete from the other first portion.

5. The turbine engine airfoil according to claim 4, wherein one of the networks of passageways is located on the pressure side and another of the passageways is located on the suction side, each of the networks of passageways including second portions fluidly connected to the second portions of other networks of passageways only through the second cooling passage.

6. The turbine engine airfoil according to claim 5, wherein at least two networks of passageways is arranged on at least one of the pressure and suction sides.

7. The turbine engine airfoil according to claim 6, wherein the at least two networks of passageways each include second portions having multiple radially spaced arcuate legs, the arcuate legs of the at least two networks of passageways arranged in alternating relationship with one another.

8. The turbine engine airfoil according to claim 2, wherein the second portions are provided by first and second sets of radially spaced apart arcuate legs, the first set of legs arranged on the pressure side and the second set of legs arranged on the suction side, the first and second sets of legs extending to a common first portion.

9. The turbine engine airfoil according to claim 1, wherein the first cooling passage provides multiple laterally spaced trenches.

10. The turbine engine airfoil according to claim 1, wherein the first cooling passage provides multiple radially spaced trenches.

11. The turbine engine airfoil according to claim 1, wherein the trench is arranged in proximity to a stagnation line on the leading edge.

12. A method of manufacturing an airfoil with internal cooling passages, the method comprising the steps of:

providing a first core having first and second portions;

arranging the first core in a mold at a location corresponding to a leading edge of an airfoil to be formed by the mold, the mold providing an airfoil contour;

arranging a second core radially within the mold, the first portion including a radially extending portion with multiple generally arcuate second portions extending generally chord-wise from the first portion, the second core supporting the second portions; and depositing casting material into the mold with the first portion extending into the mold beyond the airfoil contour and the second portion surrounded by the casting material, the first portion corresponding to a trench in the leading edge, the trench providing a radially extending slot, wherein the second portion includes multiple arcuate shaped legs radially spaced apart from one another and interconnecting the first portion to the second core.

13. The method according to claim 12, comprising the step of retaining the first portion in the mold in a core retention feature, the first portion outside of the casting material.

14. The method according to claim 12, wherein the first core includes at least one core member, the at least one core member wrapping around the leading edge generally mirroring the airfoil contour between sides, which correspond to pressure and suction sides of the airfoil.

15. The method according to claim 12, wherein the second core is a ceramic core and the first core is a refractory metal core, the first and second cores secured to one another.

16. The method according to claim 12, wherein the first core is provided by stamping a core structure including a desired shape from a refractory metallic material and bending the first core to provide a desired contour.

* * * * *